US006199656B1

(12) United States Patent
Vento et al.

(10) Patent No.: US 6,199,656 B1
(45) Date of Patent: Mar. 13, 2001

(54) CASING FOR NOISE ATTENUATION IN A ROCK DRILLING RIG

(75) Inventors: Arto Vento, Tampere; Jukka Tantari, Lempaala; Kari Saarinen, Tampere; Pasi Julkunen, Pirkkala; Veikko Lintu, Tampere; Seppo Peltola, Tampere; Tapani Sormunen, Tampere, all of (FI)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/407,766

(22) Filed: Sep. 29, 1999

(30) Foreign Application Priority Data

Sep. 29, 1998 (FI) ..... 982099

(51) Int. Cl.[7] ..... G10K 11/04

(52) U.S. Cl. ..... 181/200; 181/210; 181/196; 181/290; 175/78; 175/203; 175/113; 173/219; 173/DIG. 2

(58) Field of Search ..... 181/200, 202, 181/205, 210, 196, 198, 290, 284; 175/78, 87, 122, 162, 171, 203, 220, 257, 113; 173/29, 46, 27, 185, 219, DIG. 2

(56) References Cited

U.S. PATENT DOCUMENTS

| | | | | |
|---|---|---|---|---|
| 3,536,149 | * | 10/1970 | Laird | 175/209 |
| 3,601,205 | | 8/1971 | Kurt . | |
| 3,667,571 | | 6/1972 | Fattelay . | |
| 3,757,891 | * | 9/1973 | Krieger | 181/33 K |
| 4,040,492 | * | 8/1977 | Frederick | 173/1 |
| 4,751,971 | | 6/1988 | Thompson . | |
| 5,088,564 | * | 2/1992 | Kobayashi | 173/1 |
| 5,104,264 | * | 4/1992 | Castagner et al. | 405/244 |
| 5,810,101 | | 9/1998 | Caraway, Jr. et al. . | |

FOREIGN PATENT DOCUMENTS

| | | | | |
|---|---|---|---|---|
| 457322 | | 7/1968 | (CH) . | |
| 2356231 | * | 6/1977 | (FR) | E01C/19/00 |
| 1584888 | | 12/1977 | (GB) . | |
| 404070416 | * | 3/1992 | (JP) | 181/200 |
| 5079271 | | 3/1993 | (JP) . | |
| 5295978 | | 11/1993 | (JP) . | |
| 405295978 | * | 11/1993 | (JP) | 175/220 |
| 408028170 | * | 1/1996 | (JP) | E21B/7/02 |

* cited by examiner

*Primary Examiner*—Robert E. Nappi
*Assistant Examiner*—Edgardo San Martin
(74) *Attorney, Agent, or Firm*—Burns, Doane, Swecker & Mathis, L.L.P.

(57) ABSTRACT

A rock drilling rig includes a movable carrier with a boom attached to it and movable in various ways. The free end of the boom is provided with drilling equipment. The drilling equipment is enclosed in a casing that prevents noise generated during drilling from spreading to the surroundings. The casing is arranged to move together with a feed beam and relative to the cradle mounted on the end of the boom. A flexible noise attenuating skirt projects forwardly from a front end of the casing for forming a sealed chamber around a drilling head.

24 Claims, 1 Drawing Sheet

CASING FOR NOISE ATTENUATION IN A ROCK DRILLING RIG

TECHNICAL FIELD OF THE INVENTION

The invention relates to a rock drilling rig and especially to a noise abatement structure therefor.

PRIOR ART

Typically, a rock drilling rig for drilling into rock comprises a movable carrier equipped with a boom that is movable in various ways. The free end of the boom has the equipment necessary for actual drilling, including a rock drill as well as accessories and auxiliary equipment used for drilling into rock. The boom may be carrying, for instance, rock bolting devices for reinforcing rock, and charging equipment. Known solutions also include a cradle at the end of the boom, and a feed beam carrying the drilling equipment can be moved in relation to the cradle in -its longitudinal direction using suitable transferring mechanisms.

Most currently used solutions have no noise attenuation whatsoever for the rock drilling equipment, and the noise generated during drilling is free to spread to the surroundings of the drilling site. This causes problems especially when drilling is carried out near residential or business buildings. In such areas, the working hours are limited to certain times of the day, which, of course, considerably slows down the progress of work. For instance, drilling at night or on Sundays is out of the question in residential areas. In some cases, movable noise barriers around the drilling site have been necessary to prevent drilling noise from spreading to the surroundings. Drilling noise also causes inconvenience to those working at the site. The cabins of rock drilling rigs are usually soundproofed, but there is work at drilling sites that must be done outside the cabin. In addition, there are other persons moving or working at the site, and they may become subjected to the noise.

U.S. Pat. No. 3,667,571 presents an arrangement for dampening the noise caused by drilling. The arrangement consists of several nested casings arranged around the rock drill, with the smallest, i.e. the innermost casing, mounted to the feed beam and the successive casings fastened to the previous one with different kinds of rubber dampeners and other corresponding devices. A rail is mounted to the side of the outermost casing so that the assembly can be moved in relation to the boom end. The problem with this solution is, however, that the drilling equipment and the feed beam are connected to the boom through the flexible support elements only. This structure does not provide the required accuracy for the drilling; nor does it provide other necessary support for drilling. A casing construction of the described type is also expensive to build, and maintenance of drilling equipment becomes difficult.

Japanese Publications No. 05-079271 and No. 05-295978 present casings used in conjunction with rock drills. In both solutions, the casing is mounted to the feed beam so that it covers the rock drill over its travel length only. As most of the feed beam is left outside the casing, the problem is that drilling noise is able to escape to the surroundings through the uncovered section of the feed beam.

OBJECTS OF THE INVENTION

The objects of this invention are to provide a casing and an application for use with rock drilling rigs that avoid the disadvantages of the known solutions.

SUMMARY OF THE INVENTION

The present invention relates to a casing for noise attenuation in a rock drilling rig. The rock drilling rig comprises a carrier and a movable boom attached to it. At the free end of the boom, a cradle and a feed beam are attached, the feed beam being movable in relation to the cradle. A casing encompasses both the feed beam and the drilling equipment carried by the feed beam, in order to attenuate the noise generated during drilling. The casing includes devices for fastening it to the feed beam so as to be movable together with the feed beam in relation to the cradle. An opening at the end of the casing facing the surface to be drilled enables the drill rod to be extended therethrough.

Characteristic for the casing according to the present invention is that (a) the casing virtually completely encloses the whole drilling equipment and the feed beam, (b) the inner surface of the casing is intended to be at a distance from the feed beam and the drilling equipment, and (c) casing is provided with an opening that enables the movement of the casing and the cradle in relation to one another.

The basic idea behind the present invention is that around the drilling equipment mounted to the free end of the rock drilling rig's boom there is provided a casing structure that prevents the noise generated during drilling from spreading to the surroundings of the drilling site. The casing is arranged to cover both the drilling equipment and the feed beam substantially completely. The lower end of the casing is provided with an opening that allows the drill rod to be extended therethrough. Essential in the present invention is also that the fastening of the casing is arranged so that the casing is mounted and supported to the feed beam, and the feed beam is movable in relation to the cradle attached to the free end of the boom. An essential point is also that the casing is intended to be mounted so that there is free space between the casing and the drilling equipment as well as between the casing and the feed beam, whereby the vibrations and noise generated during drilling cannot be so easily transferred to the casing. The basic idea of a first aspect of the present invention is that also the cradle is enclosed by the casing. The basic idea of a second aspect of the present invention is that the opening that enables the movement between the casing and the cradle, or between the casing and the boom end, is provided with a noise curtain that seals the opening but allows casing movements. Further, the basic idea of a third aspect of the present invention is that the noise curtain is made of flexible bristles or strips. The basic idea of a fourth aspect of the present invention is that the casing is, at desired points, provided with hatches that can be opened and closed by remote control for observing and controlling drilling or the operation of the drilling equipment. Further, the basic idea of a fifth aspect of the present invention is that the casing comprises two nested shells with insulating material between them. Still further, the basic idea of a sixth aspect of the present invention is that the lower and of the casing, i.e. the end that faces the surface to be drilled, is provided with a flexible section that during drilling seals the gap between the lower end of the casing and the surface to be drilled.

The advantage of encapsulating is that the noise generated during rock drilling can be conveniently insulated and abated, whereby the noise no longer causes problems in the surroundings. This makes it possible to carry out drilling operations more freely even in residential areas, not restricted by the time of day or day of the week. Therefore, the degree of utilization of drilling equipment can be raised and work projects completed in less time. Noise protection pursuant to the present invention also improves working conditions, as unpleasant noise no longer exists. Noise attenuation also increases safety at work, as those working in the area are better able to hear the various warning signals and approaching vehicles. A further advantage of encapsulating is that it not only offers protection against noise but also serves as mechanical protection for the drilling equipment. The casing provides protection against dirt and dust both during operation and while in storage, which diminishes faults occurring in the equipment. The casing makes it easier to keep the drilling equipment clean while the casing itself is simple to keep clean. In addition, maintenance and repairs are easier to carry out as the drilling equipment inside the casing is cleaner. Encapsulation also protects the drilling equipment against other external influences, such as humidity and vandalism. A further advantage of the casing is that it protects the surroundings and prevents severe hazard situations in the event of sudden drilling equipment failure whereby broken fragments would fly to the surroundings. The casing also protects against persons getting caught in the moving parts of the drilling equipment. All in all, encapsulating offers significant advantages in improving safety at work. A further advantage provided by the casing is that as it forms the visible part of the equipment attached to the boom end, it can be used for improving the general appearance of the rig. The casing need not necessarily be made of any particularly strong material as it is not subjected to considerable forces. The casing does not have any role in the mounting and supporting of the drilling equipment, it merely forms a sound-proof shell around the drilling equipment. Therefore, the casing is easy to install and remove. A further advantage is that as the casing is connected to the drilling equipment only through vibration-dampened rubber bushings or equivalent dampeners, no frame noise and vibrations are transferred to the casing. A solution pursuant to the invention, with the feed beam also encapsulated, provides far better noise attenuation than solutions where noise can freely spread to the surroundings via the feed beam.

BRIEF DESCRIPTION OF THE DRAWINGS

The objects and advantages of the invention will become apparent from the following detailed description of preferred embodiments thereof in connection with the accompanying drawing in which like numerals designate like elements, and in which.

DETAILED DESCRIPTION OF PREFERRED EMBODIMENTS OF THE INVENTION

Figure 1:
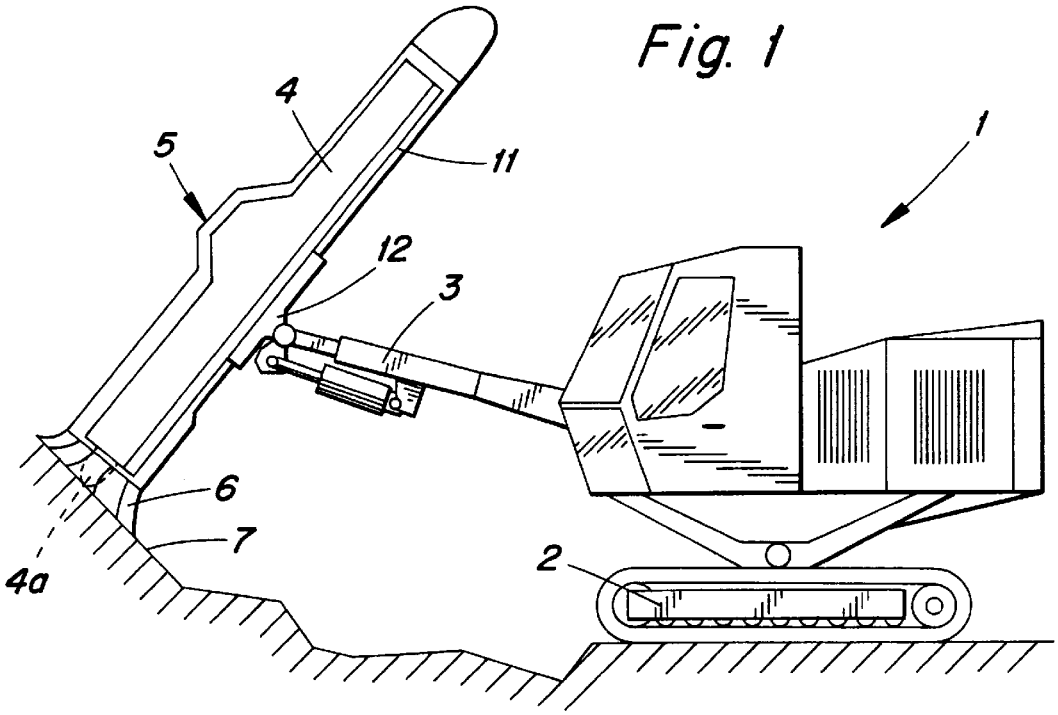
FIG. 1 shows a schematic side view of a rock drilling rig equipped with a noise attenuation casing according to one preferred embodiment of the present invention.

FIG. 1 is a schematic view of a rock drilling rig equipped with a casing according to the present invention. The drilling rig 1 comprises a movable carrier 2, a boom 3 attached to the carrier and movable in a variety of directions as is conventional. Drilling mechanism or equipment 4 having auxiliary devices is mounted to the free end of the boom 3. The drilling mechanism includes a front drilling head 4*a* for contacting the rock being drilled. In addition to the normal drilling equipment, i.e. a rock drill and rod handler, the drilling equipment may also include various rock bolting and charging devices, as well as the equipment for indexing them. The drilling equipment is mounted to a feed beam 11, in relation to which the rock drill can be moved. The feed beam is carried by a cradle 12 mounted to the end of the boom and is movable relative to the cradle. For the sake of clarity, the drilling equipment, the feed beam, and the cradle are only schematically shown in the drawings. The structure and operation of the rock drilling rig is common knowledge to persons skilled in the art, and thus need not be explained in detail. The invention, here, is that the drilling equipment 4 at the end of the boom 3 is encapsulated in a casing 5 that prevents noise generated during drilling from spreading to the surroundings. Shown schematically in longitudinal cross-section in FIG. 1, the casing 5 forms, excluding its lower end, a virtually completely closed structure that is arranged to cover the drilling equipment and the feed beam. The lower end of the casing is provided with an opening so that the drill rod and other possible devices needed in drilling can be extended through the opening. When a drilling operation is started, the movable carrier 2 is first driven to a suitable distance from the surface to be drilled, and then the drilling equipment 4 at the boom end is maneuvered to a drilling position by moving the boom 3. As already mentioned, there is a cradle 12 at the end of the boom 3, and the feed beam 11 together with the attached drilling equipment 4 can be moved in relation to the cradle 12 in the longitudinal direction of the feed beam 11. The casing according to the invention is fastened and supported to the feed beam, and arranged to move together with the feed beam in relation to the cradle. Preferably, the cradle extends partly outside the casing through an elongated opening formed in the casing that enables casing movement in relation to the cradle. The opening is preferably provided with a noise curtain 8 that seals the opening while enabling the movement of the casing.

The lower or front end of the casing is preferably provided with a flexible skirt 6 that extends farther forwardly than the drilling equipment 4 at the lower end of the casing 5 and seals the lower end of the casing against the surface to be drilled 7. A flexible skirt 6 of this type at the lower end of the casing 5 can be made of, for instance, bristles or flexible strips that are able to press against, and virtually seal around, an uneven drilling surface and, thus, prevent noise from spreading to the surroundings. The flexible skirt may also be, for instance, a telescopically compressible tube or some other suitable arrangement that can be used for noise sealing at the lower end of the casing. The sealing at the lower end of the casing prevents not only noise but also drilling dust from spreading to the surroundings. In addition, this arrangement makes it easier to extract drilling dust from the lower end of the casing, whereby problems caused by dust can be prevented at the same time. A suitable sealing arrangement can also be mounted between the casing and the flexible section at the lower end so that dust is prevented from entering farther into the casing from the lower end. On the other hand, by providing the casing with overpressure and suction at the flexible skirt, dust can be effectively prevented from accessing the drilling equipment.

Figure 2:
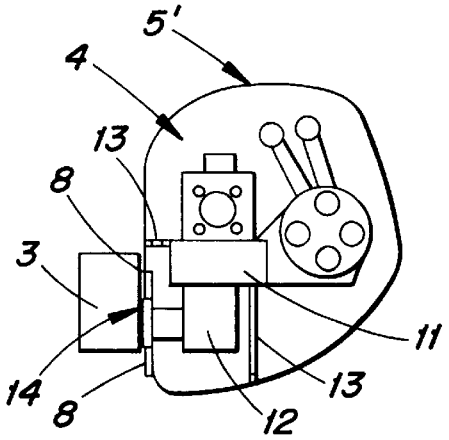
FIG. 2 shows a schematic view of an arrangement pursuant to the present invention as seen in a cross section according to the invention.

FIG. 2 is a schematic illustration of another possible casing 5' pursuant to the invention, seen in cross-section. The cross-sectional form of the casing 5' can be selected according to the particular drilling equipment 4 being used. The drilling equipment 4 is mounted to the feed beam 11 that can be longitudinally moved in relation to the boom-mounted cradle 12. The embodiment casing 5' differs from the casing 5 shown in FIG. 1 in that the casing 5' also encloses the cradle 12, and the casing 5' is provided with an elongated opening 14 for the section extending between the boom end and the cradle. This opening 14 enables casing movement. Compared with the opening in the previous casing 5 the opening 14 can, in this case, be smaller. Bristles or a flexible structure of rubber or plastic strips can be used as the noise curtain 8. The illustration also shows the brackets 13 that attach the casing 5' to the feed beam 11, to space the casing from the feed beam. The support brackets include dampeners practicably made of rubber or other corresponding material, which prevent vibrations and noise from being transferred from the feed beam to the casing.

With the casing 5' arranged so that it encloses the drilling equipment, the feed beam, and also the cradle, appreciable noise cannot be transferred along these structures to the surroundings. In addition, the casing 5' protects the sliding surfaces and other movable components of the feed beam and the cradle.

Figure 3:
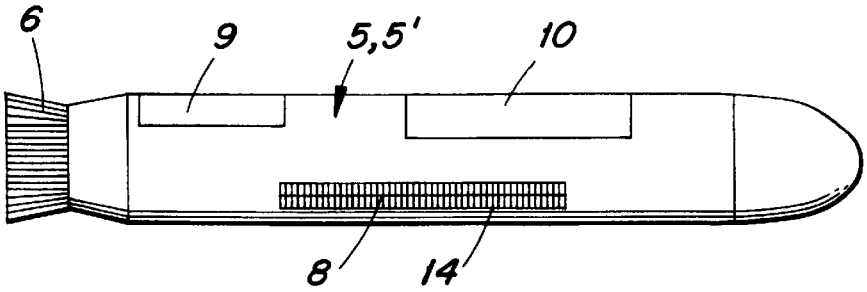
FIG. 3 shows a schematic side view of one casing pursuant to the present invention, the casing removed from the rig.

FIG. 3 shows a side view of a casing 5, 5' pursuant to the present invention. The lower end of the casing is provided with a flexible skirt 6 made of, for instance, flexible rubber or plastic strips. The flexible skirt 6 can also be made of bristles. Bristles or a structure made of other flexible parts can also be used for the noise curtain 8 which, while keeping the opening 14 closed, enables the drilling equipment and the casing arranged around it to move in relation to the boom and the cradle mounted to it. For the purpose of observing a drilling operation the casing may be provided with a first hatch 9 that can be opened by remote control from, for instance, the cabin of the rock drilling rig. A hatch of this kind enables the observation of collaring and the area around the drilled hole inlet. The casing may also be provided with a second hatch 10 that can be opened, for instance, during rod changing or when the operation of drilling requires observation for some other reason. The hatches 9 and 10 are hinged to the casing and can be opened and closed from the cabin using an actuator operated by a pressure medium or electricity. It is also possible to provide automatic control of the hatches, for instance, so that the hatches open in accord with the working cycle of the drilling equipment. The hatches, and any other part of the casing, can be made of transparent material, which makes the observation of the operation of the equipment easier still. It is clear that even more hatches can be provided and at the desired points of the casing.

A casing pursuant to the present invention can be preferably made of suitable plastic, or various composite structures can also be used. This way, the casing becomes light while still strong enough. The casing structure must be sufficiently rigid or suitably supported so that it does not vibrate harmfully during drilling. The material can be impact resistant plastic so that the casing does not suffer damage from minor knocks.

Any established technique can be used in manufacturing the casings. The casing can be made of one main component or, alternatively, can be assembled from several smaller components. A casing of the former type can be, for instance, centrifugally cast as a single unit or, when using composite structure, it can be manufactured by coiling. On the other hand, the casing can also be made by joining together deep-drawn parts, for instance, by welding. Smaller and more precise parts of the casing can be injection moulded and then integrated to the basic structure of the casing by, for instance, welding, riveting, using screws, or some other suitable means. One possibility is to form a tubular casing frame and attach to it the end sections and other parts of the casing required by the structure and operation of the drilling equipment. Furthermore, the parts forming the casing can already during their manufacture be provided with suitable, fixed connecting and fastening pieces, i.e. so-called inserts. All in all, the manufacture of a casing of plastic or other corresponding material is relatively simple, fast, and reasonably cheap.

Figure 4A:
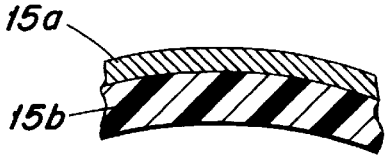
FIGS. 4*a* and 4*b* show schematic fragmentary cross-sectional views of respective preferred wall structures of a casing according to the present invention.

FIG. 4*a* shows an outlined cross-section of one possible casing shell structure. The inside of an outer casing shell 15*a* is covered with material 15*b* that has good noise attenuating properties, such as polyurethane, which can be sprayed or cast to form a layer of desired thickness. The whole inside surface of the casing can be covered with this kind of noise-attenuating layer 15*b*, or the layer can be used only at the locations where noise is generated or where it disturbs most.

Figure 4B:
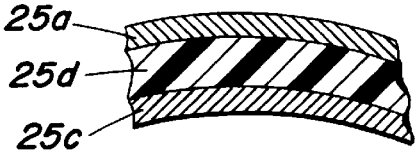

Alternatively, the casing may be composed of a shell structure shown in FIG. 4*b*, where an intermediate layer 25*d* of noise insulating material is provided between inner and outer shells 25*a* and 25*c*. A multi-layer structure of this type offers good noise insulation characteristics and, in addition, excellent rigidity in relation to its weight.

It is also possible to construct the casing, at least the part at the drilling head side, so that it provides at least reasonable protection against flying fragments in case a fault occurs in the charging device incorporated in the drilling equipment and a charge goes off prematurely, or if the rock drill breaks down and parts of it fly off.

The drawings and its explanations are only intended to illustrate the idea behind the present invention. In detail, the invention may vary within the limits of the patent claims. Thus, the material of the casing is by no means restricted to plastics and various composites, it is quite possible to make it of any other material suitable for the purpose. The cross section need not be similar to the one shown in the drawing, it can vary according to the needs. The casing may also be constructed so that the whole casing or its required points can be easily disassembled from around the drilling equipment, for instance, for maintenance and repairs.

What is claimed is:

1. A rock drilling rig comprising:

a carrier;

a boom attached to the carrier for movement relative thereto;

a cradle attached to a free end of the boom;

a feed beam attached to the cradle for movement relative thereto;

a drilling mechanism attached for movement with the feed beam;

a casing attached for movement with the feed beam and the drilling mechanism, whereby the casing, the feed beam and the drilling mechanism together constitute a movable unit movable relative to the cradle, the casing extending around and enclosing the feed beam and the drilling mechanism for attenuating noise generated during drilling, the casing being spaced from the feed beam and the drilling equipment, a front end of the casing being opened to enable a front end of the drilling mechanism to project out of the casing, the casing including an opening formed therein rearwardly of the front end for permitting the movable unit to move relative to the cradle.

2. The rock drilling rig according to claim 1 wherein a substantial portion of the cradle is enclosed by the casing.

3. The rock drilling rig according to claim 2 further including a flexible noise curtain substantially closing the opening to permit movement of the movable unit relative to the cradle.

4. The rock drilling rig according to claim 1 further including a flexible noise curtain substantially closing the opening to permit movement of the movable unit relative to the cradle.

5. The rock drilling rig according to claim 4 wherein the noise curtain comprises flexible strips.

6. The rock drilling rig according to claim 4 wherein the noise curtain comprises flexible bristles.

7. The rock drilling rig according to claim 1 wherein the casing comprises a shell and a layer of noise attenuating material attached to the shell.

8. The rock drilling rig according to claim 7 wherein the layer is disposed on an inner surface of the shell.

9. The rock drilling rig according to claim 1 wherein the casing includes inner and outer spaced apart shells and a layer of noise attenuating material disposed between the shells.

10. The rock drilling rig according to claim 1 further including a flexible skirt disposed at the front end of the casing for encompassing a front end of the drilling mechanism and engageable with a surface being drilled to form a seal against that surface.

11. The rock drilling rig according to claim 10 wherein the flexible skirt comprises flexible strips.

12. The rock drilling rig according to claim 10 wherein the flexible skirt comprises flexible bristles.

13. The rock drilling rig according to claim 1 wherein the casing includes a remotely controlled hatch for exposing a portion of the drilling mechanism for inspection.

14. The rock drilling rig according to claim 1 wherein at least a portion of the casing is formed of transparent material for exposing a portion of the drilling mechanism for inspection.

15. A casing adapted to encompass a drilling mechanism of a rock drilling rig for attenuating noise generated thereby, the casing including an open front end adapted to admit a front end of a drilling mechanism, and an elongated opening disposed rearwardly of the front end and adapted to admit a cradle; a flexible skirt mounted at the front end and projecting forwardly therepast, the skirt adapted to engage the ground and form a seal therewith; and a flexible noise curtain covering the opening and configured to enable a cradle to slide along the opening.

16. The casing according to claim 15 wherein the noise curtain comprises flexible strips.

17. The casing according to claim 15 wherein the noise curtain comprises flexible bristles.

18. The casing according to claim 15 wherein the flexible skirt comprises flexible strips.

19. The casing according to claim 15 wherein the flexible skirt comprises flexible bristles.

20. The casing according to claim 15 wherein the casing includes a shell and a layer of noise attenuating material attached to the shell.

21. The casing according to claim 20 wherein the layer is disposed on an inner surface of the shell.

22. The casing according to claim 15 wherein the casing includes inner and outer spaced apart shells, and a layer of noise attenuating material disposed therebetween.

23. The casing according to claim 15 wherein the casing includes a remotely controlled hatch.

24. The casing according to claim 15 wherein at least a portion of the casing is formed of transparent material.

* * * * *